United States Patent [19]

Müller

[11] 4,277,230

[45] Jul. 7, 1981

[54] GEAR MACHINE OPERABLE AS PUMP OR MOTOR WITH AXIALLY SPACED AND CIRCUMFERENTIALLY OFFSET PAIR OF GEARS

[75] Inventor: Karl-Heinz Müller, Vaihingen, Fed. Rep. of Germany

[73] Assignee: Robert Bosch GmbH, Stuttgart, Fed. Rep. of Germany

[21] Appl. No.: 94,661

[22] Filed: Nov. 15, 1979

Related U.S. Application Data

[63] Continuation of Ser. No. 863,301, Dec. 22, 1977, abandoned.

[30] Foreign Application Priority Data

Feb. 9, 1977 [DE] Fed. Rep. of Germany ..... 2705249

[51] Int. Cl.[3] ..... F04C 2/18; F04C 11/00; F04C 15/04; F16D 1/06

[52] U.S. Cl. ..... 418/131; 418/200; 418/212; 403/359

[58] Field of Search ..... 418/131, 132, 200, 212, 418/213; 403/359

[56] References Cited

U.S. PATENT DOCUMENTS

| | | | |
|---|---|---|---|
| 2,028,414 | 1/1936 | Schneider | 418/200 |
| 2,176,812 | 10/1939 | Glenn | 418/200 |
| 2,931,302 | 4/1960 | Dlugos | 418/200 |
| 3,100,450 | 8/1963 | Svenson | 418/200 |
| 3,237,469 | 3/1966 | Berry et al. | 403/359 |
| 3,272,140 | 9/1966 | Curry et al. | 418/200 |
| 3,291,052 | 12/1966 | Weaver et al. | 418/200 |

FOREIGN PATENT DOCUMENTS

| | | | |
|---|---|---|---|
| 18087 | 12/1956 | Fed. Rep. of Germany | 418/200 |
| 168394 | 8/1959 | Sweden | 418/200 |
| 609108 | 9/1948 | United Kingdom | 418/200 |

*Primary Examiner*—John J. Vrablik
*Attorney, Agent, or Firm*—Michael J. Striker

[57] ABSTRACT

A gear pump or a hydraulic gear motor has two pairs of meshing external gears, in which the teeth of one of the gears of each pair of gears are circumferentially displaced with respect to the teeth on the other gear of the pair. The gears arranged on the drive shaft are connected by the latter by an internal gearing, especially by splines, whereby the number of the teeth of the internal gearing is an even multiple, especially twice, the number of the external teeth of these gears.

9 Claims, 5 Drawing Figures

GEAR MACHINE OPERABLE AS PUMP OR MOTOR WITH AXIALLY SPACED AND CIRCUMFERENTIALLY OFFSET PAIR OF GEARS

This is a continuation of application Ser. No. 863,301, filed Dec. 22, 1977, now abandoned.

BACKGROUND OF THE INVENTION

The present invention relates to a gear machine which is operable as pump or motor and which has two pairs of meshing external gears and in which the teeth of one of the gears on the drive shaft are circumferentially displaced from the teeth of the other gear on the drive shaft. In such machines known in the art, the gears are fastened to the drive shaft by a groove and key arrangement. This requires a great effort during mounting of the gears and entails also shortcomings in the transmission of the turning moment.

SUMMARY OF THE INVENTION

It is an object of the present invention to provide a gear machine which is operable as pump or motor and which avoids the disadvantages of such gear machines known in the art.

It is a further object of the present invention to facilitate the mounting of the gears on the drive, or driven shaft, to assure that the turning moment is at all times transmitted in a perfect manner between the gears and the shaft and especially to determine the desired angle at which the two gears on the shaft are circumferentially displaced with respect to each other.

With these and other objects in view, which will become apparent as the description proceeds, the gear machine according to the present invention, which is operable as pump or motor, mainly comprises housing means having a central portion with an inner surface and opposite open ends and a pair of covers closing the open ends and defining with the aforementioned inner surface of the central portion a chamber, a first shaft mounted for rotation about its axis in the aforementioned chamber and projecting with an end portion thereof through an opening in one of the covers to the outside of the housing means, a pair of first external gears arranged spaced from each other in axial direction and offset in circumferential direction from each other about portions of the first shaft, in which each of the first gears is provided with an internal gearing and the portions of the shaft are provided with an external gearing, meshing with the internal gearing of the pair of first gears, to connect this pair of first gears to the shaft for rotation therewith, and in which the number of teeth of the internal gearing on the first pair of gears is an even multiple of the number of external teeth thereon. The machine includes further a second shaft arranged parallel to the first shaft in the housing means and a pair of second external gears on the second shaft, respectively meshing with the first pair of external gears.

Preferably, the number of teeth of the internal gearing on the first pair of gears is twice the number of external teeth provided thereon.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
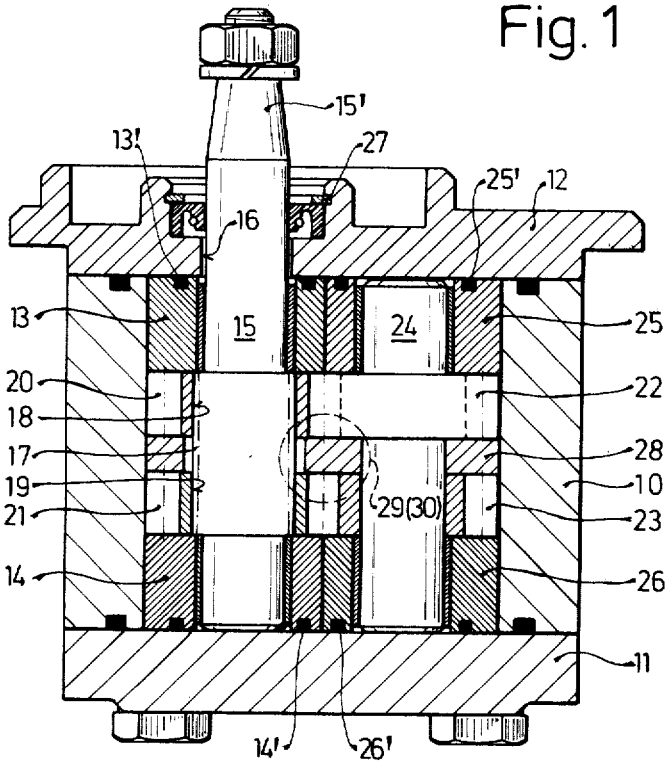
FIG. 1 is a longitudinal cross section through one embodiment of a gear machine according to the present invention.
Figure 5:
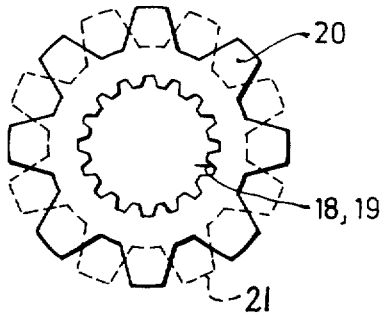
FIG. 5 is a top view of the gears to be mounted on the drive or driven shaft of the machine and showing the displacement of the gears through half a pitch.

Referring now to the drawing, and especially to FIG. 1 of the same, it will be seen that the gear machine according to the present invention, which is operable as pump or motor, mainly comprises housing means including a central portion 10 having an inner surface and opposite open ends, which are respectively closed by covers 11 and 12, connected by screws or the like to the central portion 10. The two covers 11 and 12 define with the central portion 10 of the housing means a chamber, in which a first shaft 15 is mounted for rotation about its axis on bearings 13 and 14, which abut with end faces thereof respectively against the covers 12 and 11. The first shaft 15 extends with an end portion 15' thereof through an opening in the cover 12 beyond the latter to the outside of the housing means, properly sealed by a sealing ring 27 arranged within the cover 12. The shaft 15 may be driven, if the gear machine is used as a pump, through an appropriate transmission, one member of which is to be fixed to the end portion 15' of the shaft and such transmission elements do not form part of the present invention and are therefore not illustrated in the drawing. If the machine is to be operated as motor, the shaft 15 is of course the output shaft.

The first shaft 15 is provided between the bearings 13 and 14 on its outer peripheral surface thereof with a gearing 17, especially splines, on which two axially displaced gears 20 and 21 are fixed for rotation with the shaft 15 by means of internal gearings 18 and 19. The number of teeth of the internal gearing 18, respectively 19, as well as the number of splines 17 on the peripheral surface of the shaft 15, is an even multiple of the number of external teeth on the gears 20 and 21 and preferably the number of internal teeth 18 and 19 on the gears 20 and 21 is twice the number of the external teeth of these gears. A second shaft 24 is turnably mounted within the housing means on bearings 25 and 26, likewise abutting with end faces thereof against the corresponding faces of the covers 12 and 11 and a pair of axially displaced gears 22 and 23, respectively meshing with the gears 20 and 21, is mounted on the shaft 24. The gear 22 is preferably integrally formed with the shaft 24, whereas the gear 23 is loosely mounted thereon.

An intermediate plate 28 is arranged between the pair of gears 20, 22 and 21, 23. Sealing rings 13', 14', 25' and 26' are respectively arranged in corresponding grooves in the end faces of the bearings 13, 14, 25 and 26, which respectively abut against corresponding faces of the covers 11 and 12 to create, in a known manner, pressure fields which press the opposite end faces of the bearings respectively against corresponding end faces of the gears.

It is further essential that the gears 20 and 21 are displaced with respect to each other in circumferential direction, for instance through half a pitch. This can easily be obtained by means of the described gearing 17–19 provided on the gears 20 and 21 and the shaft 15. If the number of internal teeth 18 and 19 on the gears 20 and 21 is twice the number of external teeth thereon, the desired angle through which the gears 20 and 21 are displaced in circumferential direction from each other can be easily obtained. After the gear 20 is pushed onto the shaft 15, the other gear 21 need only be pushed onto the shaft displaced through one pitch of the internal gearing in order to obtain the desired circumferential displacement of the two gears through half a pitch. If the number of internal teeth on the two gears 20 and 21 is four times the number of external teeth thereon, then a circumferential displacement of the two gears through a a quarter, or three-quarters of the pitch thereof can be obtained.

The position of the internal teeth relative to the external teeth on the two gears 20 and 21 can be chosen in any manner whatsoever, however, the relative position has to be the same in both gears 20 and 21.

Inlet and outlet bores 29 and 30 are arranged on diametrically opposite sides in the central portion 10 of the housing in the region of the intermediate plate 28. The arrangement of the inlet and outlet bores 29 and 30 does not form part of the invention and these bores are therefore only schematically illustrated in form of dash-dotted circles in FIG. 1.

By displacing the gears 20 and 21 in circumferential direction from each other a reduction of pulsation of the delivered fluid stream is obtained in a manner known per se and therefore not further described.

Figure 2:
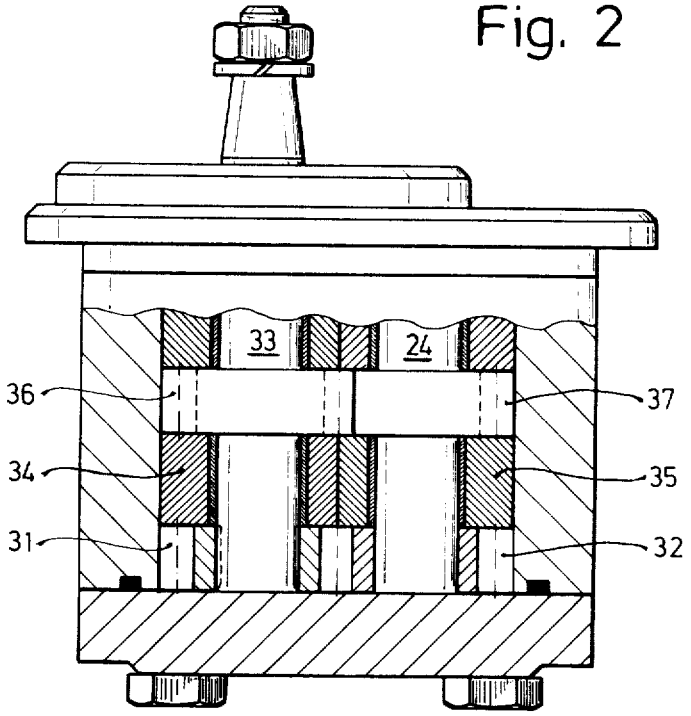
FIG. 2 is a partially sectioned side view of a second embodiment according to the present invention.

The embodiment shown in FIG. 2 of the drawing is similar to the above described embodiment illustrated in FIG. 1. As can be seen from FIG. 2 there is again a shaft 33, which is a driven shaft, if the machine is operated as pump or the output shaft if the machine is operated as motor, mounted on a pair of bearings in the interior of the housing and a pair of gears 36 and 31 are connected to the shaft 33 for rotation therewith circumferentially displaced from each other in the manner as described above. A second shaft 24 is likewise mounted in the interior of the housing by a pair of bearings for rotation about its axis and a pair of axially displaced gears 37 and 32, respectively meshing with the gears 36 and 31 are mounted on the shaft 24, whereby the gear 37 may be integrally formed with the shaft 24, whereas the gear 32 may be loosely mounted thereon. The construction shown in FIG. 2 differs however from the above described construction, illustrated in FIG. 1, in that the bearings 34 and 35 are arranged respectively in the space between the two gears 36, 31 and 37, 32, so that the gears 31 and 32 are mounted in overhung position on the shafts 33 and 24, respectively. This construction has the advantage that the intermediate plate 28, shown in FIG. 1, becomes unnecessary. Thereby, the length of the arrangement illustrated in FIG. 2 is reduced, as compared with the arrangement shown in FIG. 1. The bearings 34 and 35 will also carry out the sealing function between the pressure and suction space of the machine.

Figure 3:
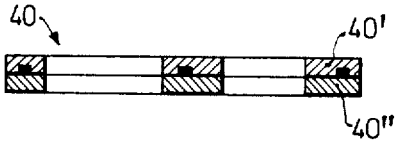
FIG. 3 is an axial cross section of a modified element of the embodiment shown in FIG. 1.
Figure 4:
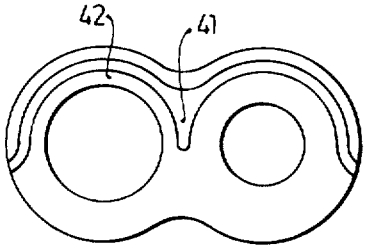
FIG. 4 is a top view of the element shown in FIG. 3.

FIGS. 3 and 4 illustrate a modification of the intermediate plate 28 shown in FIG. 1. The intermediate plate 40, shown in FIG. 3, is composed of two plate halves 40' and 40'' abutting against each other along a plane normal to the gear axes. One of the gear halves, for instance 40', is provided with a groove, as best shown in FIG. 4, in which a sealing strip 41 is arranged by means of which a pressure field 42 is formed, in a known manner, between the two plate halves 40' and 40''. In this pressure field a pressure substantially equal to the delivery pressure is obtained so that the two plate halves are pressed in a sealing manner against the corresponding end faces of the gears, whereby the above described sealing rings on the end faces of the bearings, which respectively engage the covers, may be omitted.

It will be understood that each of the elements described above, or two or more together, may also find a useful application in other types of gear machines operable as pump or motor differing from the types described above.

While the invention has been illustrated and described as embodied in a gear machine operable as pump or motor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a gear machine operable as pump or motor, a combination comprising housing means including a central portion having an inner surface and opposite open ends and a pair of covers closing said opposite ends and defining with said inner surface of said central portion a chamber; a first shaft mounted for rotation about its axis in said chamber and projecting with an end portion thereof through an opening in one of said covers to the outside of said housing means; a pair of first external gears arranged spaced from each other in axial direction and offset in circumferential direction from each other about portions of said first shaft, each of said first gears being provided with an internal gearing having uniformly spaced teeth and said portions of said first shaft being provided with an external gearing meshing with said internal gearing of said pair of first gears to connect said pair of first gears to said shaft for rotation therewith, the number of gear teeth of said internal gearings on said first pair of gears being an even multiple of the number of external gear teeth thereon, the number of teeth of the internal gearings enabling the offset to be one half or other than one half the pitch of the external gear teeth; a second shaft arranged parallel to said first shaft in said housing means; and a pair of second external gears on said second shaft respectively in direct driving engagement with said first pair of external gears.

2. A combination as defined in claim 1, wherein said external gearing on said portions of said first shaft is in the form of splines extending from one to the other of said portions.

3. A combination as defined in claim 1, wherein the circumferential position of the internal gearing of said first pair of external gears can be arranged in any manner with regard to the external teeth thereon, but is identical in both gears of said first pair of gears.

4. A combination as defined in claim 1, wherein the external gear teeth of said first pair of external gears on said first shaft are circumferentially displaced from each other through half a pitch and wherein the number of teeth on the internal gearing of said first pair of gears is twice the number of external gear teeth, provided thereon.

5. A combination as defined in claim 1, and including an intermediate plate between the two pairs of gears, said intermediate plate being provided with openings through which said first and said second shaft respectively extend.

6. A combination as defined in claim 5, wherein said intermediate plate is divided in a plane normal to the axes of said gears into two plane halves, and including a sealing strip extending partly about said openings and providing a pressure field pressing said plate halves against corresponding end faces of said gears.

7. A combination as defined in claim 1, and including a pair of bearings within said chamber for each of said shafts.

8. A combination as defined in claim 7, wherein said bearings of each pair have opposite end faces respectively engaging said covers and corresponding end faces of said gears.

9. A combination as defined in claim 7, wherein one gear of each pair of gears engages with an end face thereof the other of said pair of covers and wherein one of each pair of bearings is arranged to engage with opposite end faces thereof the other end face of said one gear and the corresponding end face of the other gear of each pair of gears.

* * * * *